US005947042A

United States Patent [19]

Beyer et al.

[11] Patent Number: 5,947,042

[45] Date of Patent: Sep. 7, 1999

[54] DIVIDING SINKER WITH MODULES FOR TUFTING TOOLS

[76] Inventors: Walter Beyer, Patternhof 30, D-52249 Eschweiler, Germany; Derek White, 206 Hoghton Lane, Higher Walton, Preston, Lancashire, PR5 4EH, United Kingdom

[21] Appl. No.: 08/945,936

[22] PCT Filed: Apr. 17, 1996

[86] PCT No.: PCT/DE96/00667

§ 371 Date: Jan. 20, 1998

§ 102(e) Date: Jan. 20, 1998

[87] PCT Pub. No.: WO96/34140

PCT Pub. Date: Oct. 31, 1996

[30] Foreign Application Priority Data

Apr. 28, 1995 [DE] Germany ..... 296 06 953 U

[51] Int. Cl.[6] ..... D05C 11/04

[52] U.S. Cl. ..... 112/80.45

[58] Field of Search ..... 112/80.4, 80.45, 112/163, 78, 80.5

[56] References Cited

U.S. PATENT DOCUMENTS

| | | | |
|---|---|---|---|
| 3,485,195 | 12/1969 | Torrence | 112/80.45 X |
| 4,138,956 | 2/1979 | Parsons | 112/80.45 X |
| 5,158,028 | 10/1992 | Beyer | 112/80.45 |
| 5,295,450 | 3/1994 | Neely | 112/80.45 |
| 5,396,852 | 3/1995 | Bardsley | 112/80.45 |

*Primary Examiner*—Ismael Izaguirre
*Attorney, Agent, or Firm*—David C. Purdue; John C. Purdue

[57] ABSTRACT

A combination of a bar having a bore therein, and a tufting tool module for the bar including a bore extending therethrough. A fastening screw extending through the bore of the module, and threaded into a cooperatively threaded portion of the bore of the bar. The module has a plate shaped body having a first plane face which bears against a first plane face of the bar, and is urged into contact with that face by the fastening screw. There is a first stop strip extending from the first face and along a first edge of the module body. The first face of the module body is locked in a given angular position relative to the fastening screw. In one embodiment a first collar which projects from the first face of the module body, is positioned annularly around the bore and received in the bar with a locating fit. The first stop strip is closely adjacent the surface of the bar. In another embodiment the module is locked by an unthreaded portion of the shank of the fastening screw which extends through an unthreaded portion of the bore of the bar with a locating fit. In a third embodiment, the body is locked by a locking pin having one end seated in the module body adjacent its first plane surface, and the other end seated in the bar adjacent its first plane surface.

6 Claims, 5 Drawing Sheets

DIVIDING SINKER WITH MODULES FOR TUFTING TOOLS

DESCRIPTION

The invention relates to a bar with modules for tufting tools, in particular a needle bar with needle modules, in which the tufting tools are cast at one end into a plate-shaped basic module body, the length of which corresponds to a multiple of the centre-to-centre distance of the cast-in tufting tools and which has a plane face which rests against the bar and which is provided with a projecting stop strip at its edge running longitudinally in the region of the emergence of the tufting tools from the basic body, the said basic body having at least one continuous bore, through which a fastening screw can be screwed into a threaded bore.

DESCRIPTION OF THE RELATED ART

It is known to cast a row of tufting, knitting or Raschel tools, for example needles or grippers, into a basic module body at an exact location and subsequently to fasten the modules, consisting of the tools and the basic module body, to a bar, for example the needle bar of a tufting machine. For fixing to the bar, the basic module body is provided with a bore, through which a fastening screw is led. A corresponding threaded bore is provided in the bar. In addition, the basic module body has formed on it a rectangular stop strip which is intended to fix the module in the direction of the bar and which transmits the force acting in the direction of the tools from the module to the bar.

Particularly in the case of relatively long tools and when working with racked stitches, the considerable yarn forces on the tools result in a torque which acts on the modules and which may be so great that the module is twisted. Although twisting is limited by the existing stop strip, it is not prevented, since the stop strip, because of its tolerances, allows the module to twist, albeit only slightly. Even this twisting is undesirable, since it leads to an irregular structure of the material produced by means of the tools, for example a tufting fabric. If the torque forces act in both directions, the module may even be loosened.

SUMMARY OF THE INVENTION

The object on which the invention is based is to design the modules or bars in such a way that twisting or loosening of a module is ruled out.

The object is achieved, according to the invention, in that the basic module body, when its stop strip rests closely against the bar, is positioned against the bar by means of a locating connection.

Inventively, the arrangement may be designed in such a way that the locating connection has a collar projecting on the plane face as well as a matching recess in the bar.

Inventively, the arrangement may be designed in such a way that the collar surrounds the bore in the module annularly.

Inventively, the arrangement may also be designed in such a way that the fastening screw takes the form of a locating screw which is seated with a locating fit in the bore of the module.

Inventively, the arrangement may also be designed in such a way that at least one locating pin is provided which engages with one end into the basic module body and with its other end into the bar.

Inventively, the arrangement may be designed in such a way that the stop strip is formed on both sides of the module.

Inventively, the arrangement may also be designed in such a way that the collar is formed on both sides of the module.

The advantage of arranging the stop strip or the collar on both sides of the module is that the module may also be installed so as to be rotated through 180°.

Inventively, the arrangement may be designed in such a way that the collar or collars is or are formed on the module by the injection-molding method.

The advantage of the invention is that the module is permanently fixed to the bar in all directions and the possibility of loosening is ruled out.

The invention will be explained in more detail with reference to two exemplary embodiments. In the accompanying drawings:

DESCRIPTION OF THE PREFERRED EMBODIMENTS

Figure 2:
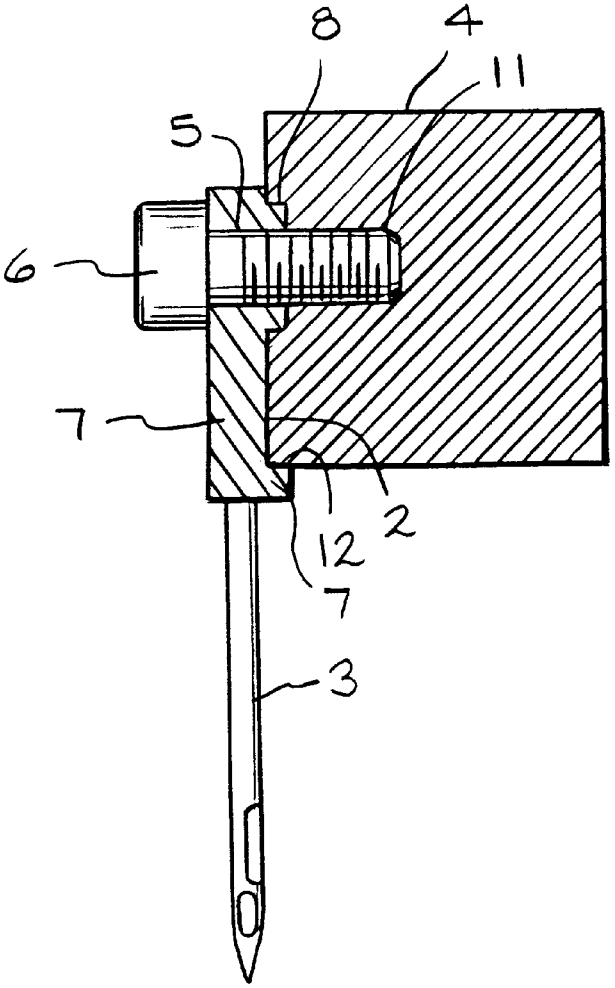
FIG. 2 shows a partially sectional side view of the arrangement according to FIG. 1.

The module shown in the figures has a basic body 1 with a bearing face 2. The butts of tufting needles 3 are cast into the basic body 1. The module rests with the bearing face 2 against a needle bar 4. The basic body 1 is provided with a bore 5. The module is fastened to the needle bar 4 by means of a screw 6.

The axes of the tufting needles 3 lie parallel to one another in a plane of symmetry of the basic body 1.

Figure 6:
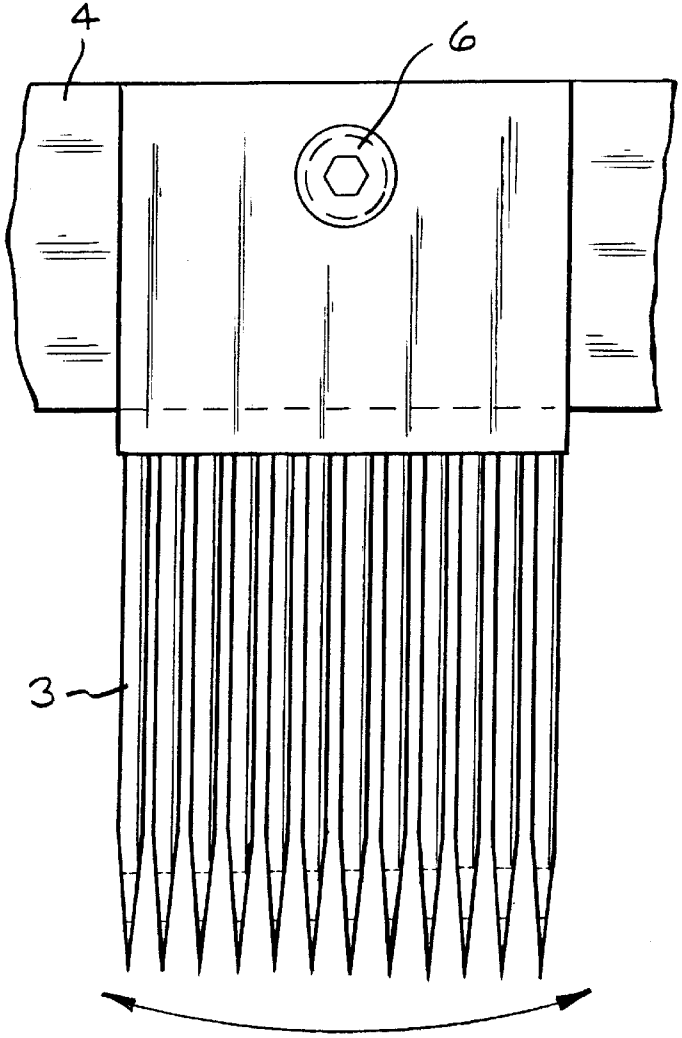
FIG. 6 shows a front view of the arrangement according to FIG. 5.
Figure 5:
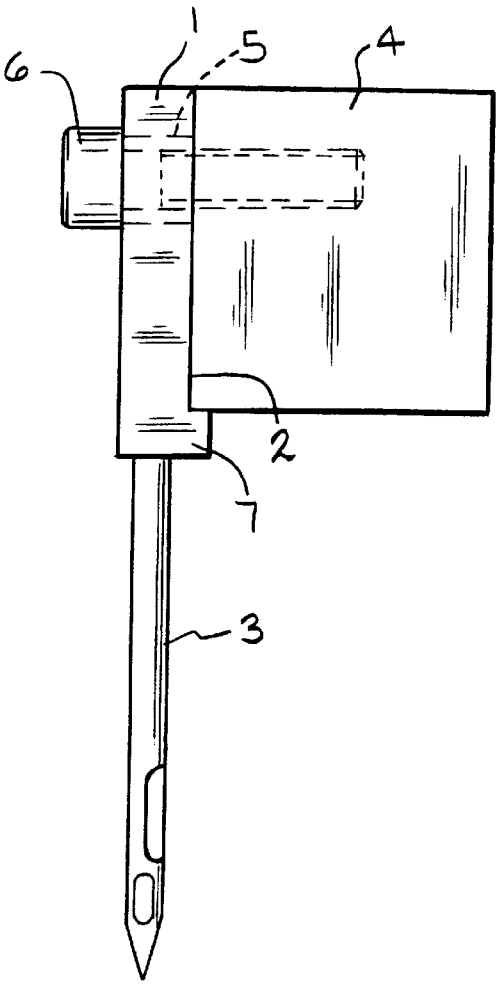
FIG. 5 shows a side view of a conventional type of fastening of a needle module to a needle bar.

FIG. 5 shows the conventional fastening of a needle module to a needle bar. The basic module body 1 has, at the lower end, a stop strip 7 which projects relative to the bearing face 2 and which is intended to limit the movement of the module in the vertical direction. On account of the tolerances, however, a slight twisting of the module may nevertheless occur, as indicated by the arrows in FIG. 6.

Figure 1:
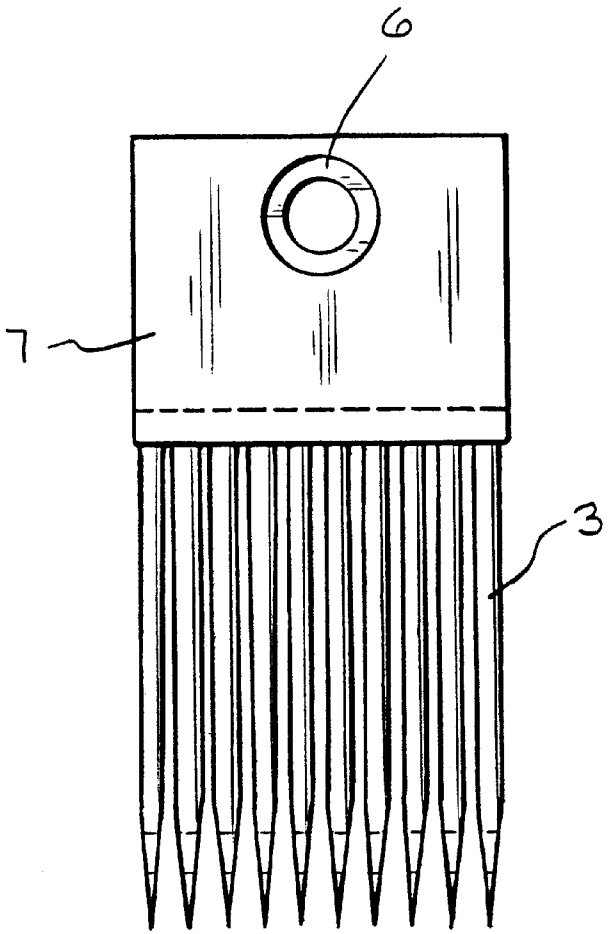
FIG. 1 shows a front view of an embodiment of the invention.
Figure 4:
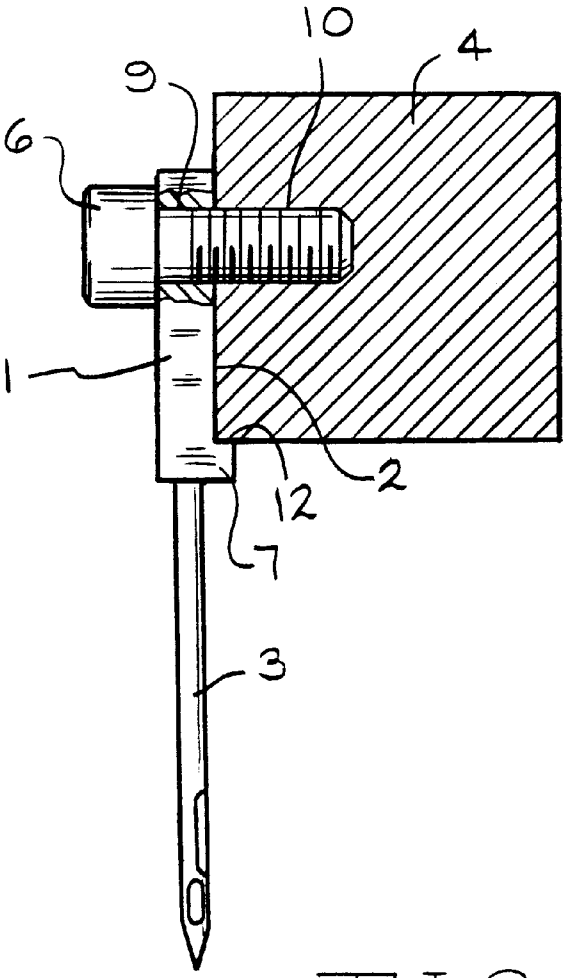
FIG. 4 shows a partially sectional side view of the arrangement according to FIG. 3.

FIG. 1, then, shows the design according to the invention. The basic module body 1 is connected to the needle bar 4 with a locating fit. For this purpose, the bearing face 2 of the basic body 1 has formed on it a collar 8 which surrounds the bore 5 coaxially and which engages with a locating fit into a corresponding recess in the needle bar 4 and fixes the needle module in the plane of the bearing face 2. Moreover, the stop strip 7, with respect to the bore 5, and the bore 11 in the needle bar 4, with respect to the edge 12 of the needle bar 4, operate so as to bring about a locating fit, thereby ensuring the security of the module against twisting relative to the bar 4. By means of the locating connections, the module is thus fixed in all directions and can no longer be twisted or loosened, even under high load, including torque forces.

Figure 3:
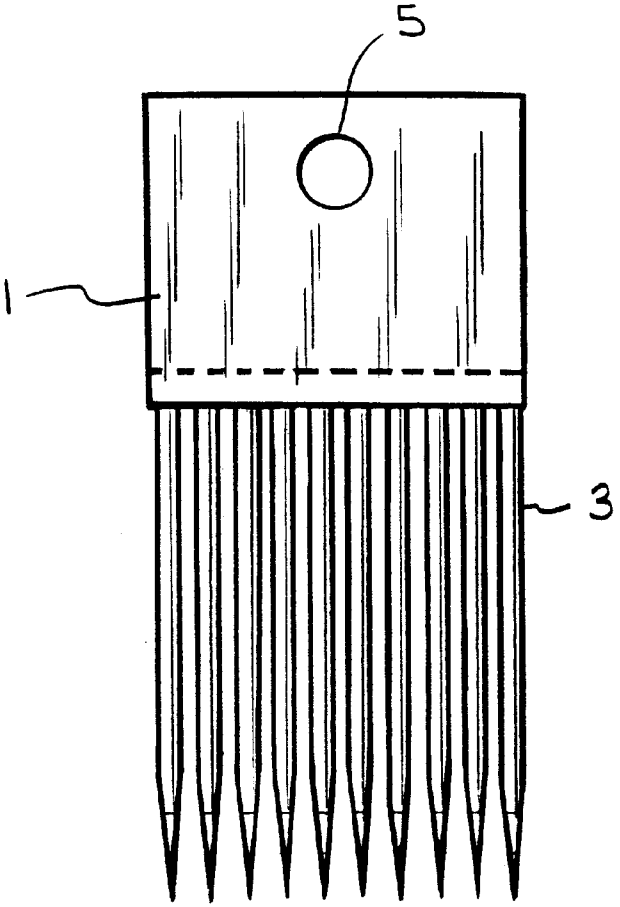
FIG. 3 shows a front view of a second embodiment of the invention.

FIG. 3 shows a further variant of the invention. Instead of the locating connection made by means of the collar 8, as provided according to FIG. 1, and a corresponding recess, a locating connection between the screw 6 and the basic needle module body 1 is provided. For this purpose, the screw 6 is designed as a locating screw and has a threadless shank part 9, the cross-section of which is slightly larger than the cross-section of the threaded part 10. The bore 5 and shank part 9 operate so as to ensure a locating fit, so that no relative movement is possible between the screw 6 and the module. Together with the locating fit ensured by the stop strip 7 and the edge 12 of the needle bar 4, any movability of the module relative to the needle bar 4 in the assembled state is reliably prevented.

Figure 7:
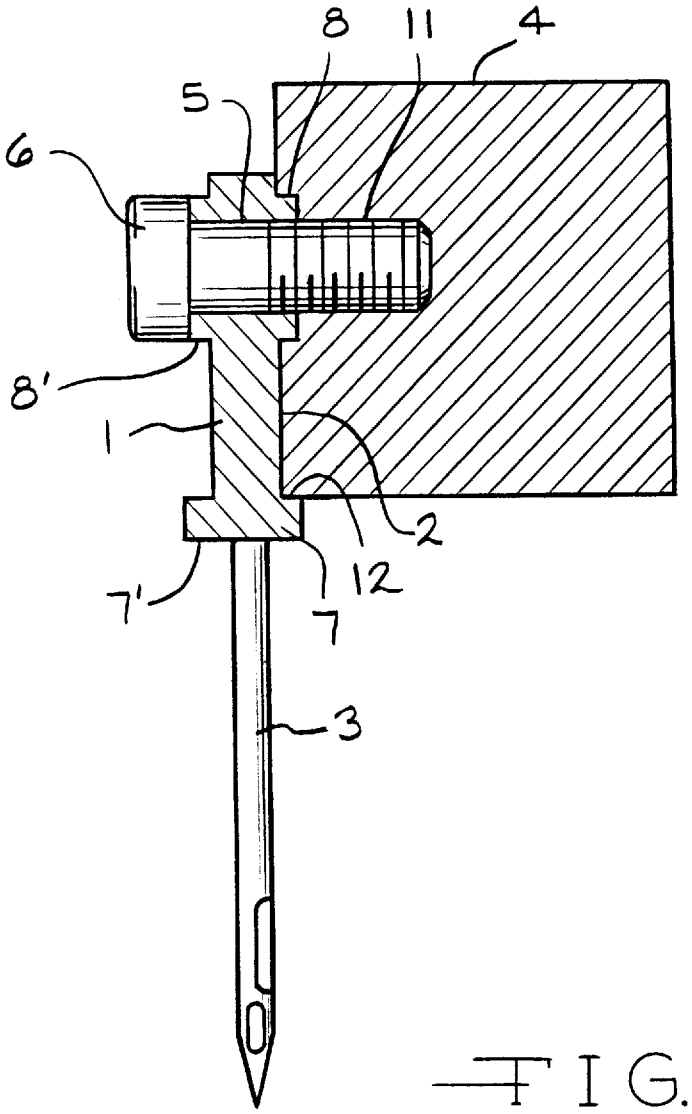
FIG. 7 shows a partially sectional side view of a third embodiment of the invention.

FIG. 7 shows a variation of FIG. 2 where the collar 8 is formed on both sides of the basic module body 1, that on the second side being designated 8', and the stop strip 7 is formed on both sides of the body 1, that on the second side being designated 7'.

Figure 9:
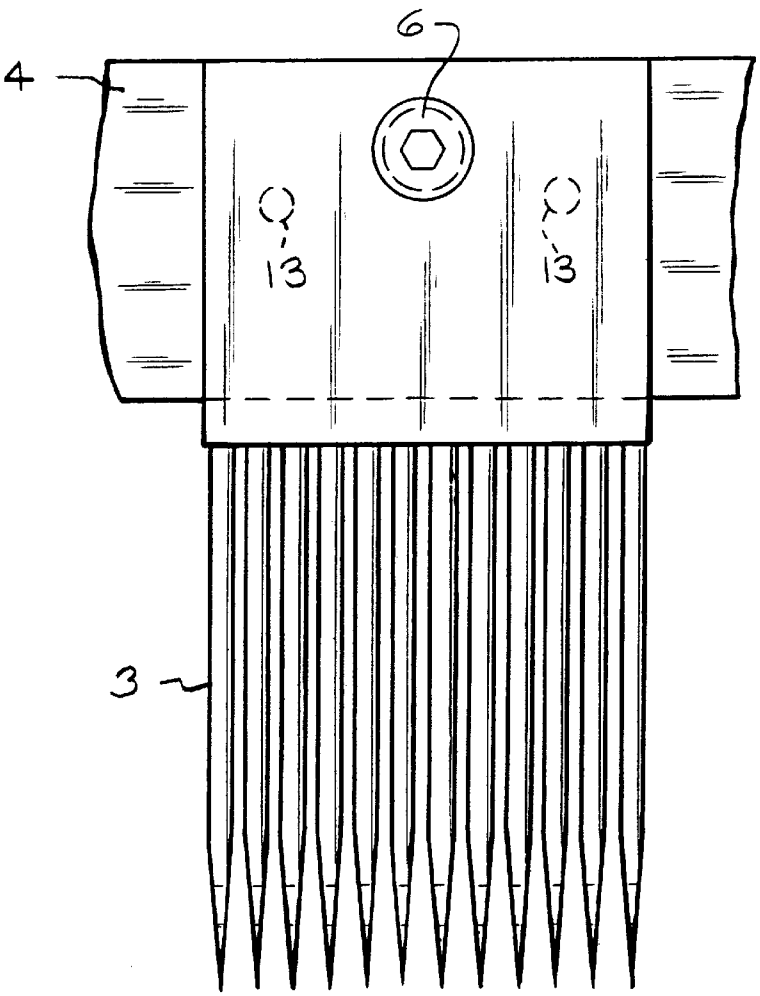
FIG. 9 shows a front view of the fourth embodiment of the invention.
Figure 8:
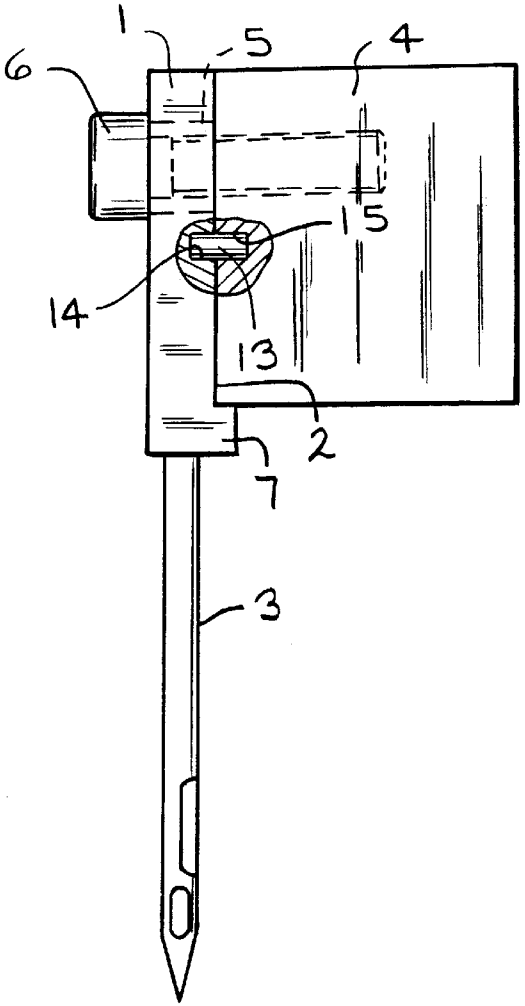
FIG. 8 shows a partially sectional side view of a fourth embodiment of the invention.

FIGS. 8 and 9 show another variant where pins 13, which are received in recesses 14 and 15, provide a locating connection which fixes the needle module 1 in the plane of the face 2 and ensures the security of the module against twisting relative to the bar 4.

The embodiments described have been illustrated and described solely in conjunction with tufting needles. Instead of needles, however, the arrangement may also extend to other tools, for example loopers and grippers.

We claim:

1. In combination, a bar having a bore therein, a tufting tool module therefor, said tufting tool module having a bore extending therethrough, and a fastening screw extending through the bore of said tool module, and being threaded into a cooperatively threaded portion of the bore of said bar, said module comprising a plate shaped module body having a first plane face which bears against a first plane face of said bar, and is urged into contact with the first face of said bar by said fastening screw, a first stop strip extending from the first face of said module body and along a first edge thereof, a plurality of tufting tools supported in said body, adjacent to said first stop strip, and extending from said body, and means locking the first face of said module body in a given angular position relative to said fastening screw, said last-named means comprising a first collar projecting from said first face of said module body, being positioned annularly around said bore, and being received in a recess in said bar in which said first collar has a locating fit, said tool module being in such a rotational position relative to said bar, and being so shaped, that said first stop strip is closely adjacent the first surface of said bar.

2. An assembly of a bar, a tufting tool module therefor, and a fastening screw as claimed in claim 1 wherein said tool module has a second plane face and a second stop strip extending from the second face of said module body and along a first edge thereof, and said module is so shaped that it can be assembled with said bar and said fastening screw so that, when said module is in a given rotational position, the second face of said module body bears against the first face of said bar and said second stop strip is closely adjacent said first surface of said bar.

3. An assembly of a bar, a tufting tool module therefor, and a fastening screw as claimed in claim 2 wherein there is a second collar which projects from the second face of said module body, is positioned annularly around said bore, and is sized to be received in the recess in said bar and to have a locating fit therewith.

4. An assembly of a bar, a tufting tool module therefor, and a fastening screw as claimed in claim 1 or 3 wherein said collar or each of said collars is formed on the module by an injection molding method.

5. In combination, a bar having a bore therein, a tufting tool module therefor, said tufting tool module having a bore extending therethrough, and a fastening screw extending through the bore of said tool module, and being threaded into a cooperatively threaded portion of the bore of said bar, said module comprising a plate shaped module body having a first plane face which bears against a first plane face of said bar, and is urged into contact with the first face of said bar by said fastening screw, a first stop strip extending from the first face of said module body and along a first edge thereof, a plurality of tufting tools supported in said body, adjacent to said first stop strip, and extending from said body, and means locking the first face of said module body in a given angular position relative to said fastening screw, said last-named means comprising an unthreaded portion of the shank of said fastening screw which extends through an unthreaded portion of the bore of said bar, and is sized to have a locating fit therewith, said tool module being in such a rotational position relative to said bar, and being so shaped, that said first stop strip is closely adjacent the first surface of said bar.

6. In combination, a bar having a bore therein, a tufting tool module therefor, said tufting tool module having a bore extending therethrough, and a fastening screw extending through the bore of said tool module, and being threaded into a cooperatively threaded portion of the bore of said bar, said module comprising a plate shaped module body having a first plane face which bears against a first plane face of said bar, and is urged into contact with the first face of said bar by said fastening screw, a first stop strip extending from the first face of said module body and along a first edge thereof, a plurality of tufting tools supported in said body, adjacent to said first stop strip, and extending from said body, and means locking the first face of said module body in a given angular position relative to said fastening screw, said last-named means comprising a locking pin with one end seated in said module body adjacent said first plane surface thereof and the other end seated in said bar adjacent said first plane surface thereof, said tool module being in such a rotational position relative to said bar, and being so shaped, that said first stop strip is closely adjacent the first surface of said bar.

* * * * *